United States Patent [19]

Wilderson et al.

[11] Patent Number: 4,474,579

[45] Date of Patent: Oct. 2, 1984

[54] PROCESS FOR IMPROVING THE COMBUSTION OF DIESEL ENGINE FUELS

[75] Inventors: Manfred Wilderson, Eschweiler; Werner DeWin, Dinslaken; Bela Tihanyi, Schermbeck; Jürgen Weber, Oberhausen, all of Fed. Rep. of Germany

[73] Assignees: Ruhrchemie Aktiengesellschaft; Wenzel & Weidmann G.m.b.H., both of Fed. Rep. of Germany

[21] Appl. No.: 441,793

[22] Filed: Nov. 15, 1982

[30] Foreign Application Priority Data

Feb. 18, 1982 [DE] Fed. Rep. of Germany ..... 3205732

[51] Int. Cl.[3] ..... C10L 1/18

[52] U.S. Cl. ..... 44/57; 44/66; 44/68

[58] Field of Search ..... 44/57, 68, 66

[56] References Cited

U.S. PATENT DOCUMENTS

| | | | |
|---|---|---|---|
| 1,771,169 | 7/1930 | Egerton | 44/68 |
| 3,003,859 | 10/1961 | Irish et al. | 44/57 |
| 3,205,053 | 9/1965 | McCord | 44/68 |
| 3,594,138 | 7/1971 | Badin | 44/66 |
| 4,133,648 | 1/1979 | Deffner | 44/68 |
| 4,264,335 | 4/1981 | Bello et al. | 44/68 |
| 4,336,148 | 6/1982 | Wirth et al. | 44/68 |

*Primary Examiner*—Y. Harris-Smith

*Attorney, Agent, or Firm*—Jordan B. Bierman; Linda Bierman

[57] ABSTRACT

In order to improve the combustion of diesel engine fuels, mixtures of neutral salts of carboxylic acids and metals of Atomic Nos. 57 to 71 and free carboxylic acids are added thereto.

32 Claims, No Drawings

PROCESS FOR IMPROVING THE COMBUSTION OF DIESEL ENGINE FUELS

The present invention relates to a process for improving the combustion of diesel engine fuels by the addition of mixtures of free carboxylic acids and salts of organic acids with the lanthanoids.

Diesel fuels have a greater tendency than gasoline to form soot during combustion. Soot formation is caused by the fact that the combustion process in the engine takes place incompletely; i.e. the energy recovery from the fuel is not fully utilized. Quite apart from the poor utilization of the fuel, diesel smoke is produced which contains, inter alia, hydrocarbons and carbon monoxide, and seriously pollutes the environment. For this reason attempts have been made for a long time to suppress soot formation in the combustion of diesel fuels by the use of additives, and to insure combustion which is as complete as possible.

It is already known to produce cerium soaps, in which one atom of trivalent cerium is essentially combined with three molecules of a fatty acid, by reacting a carboxylic acid having more than 8 carbon atoms with cerium hydroxide. These compounds are used as siccatives in the paint, lacquer and varnish sector, and also as combustion auxiliaries.

According to DOS. No. 27 29 365, cerium salts of organic acids, of sulfonic acids, or of phosphoric acids, which are substituted by an organic radical, are also useful as combustion auxiliaries. Their main area of application, however, is as siccatives for paints and lacquers.

The afore-mentioned compounds do not meet all the requirements of a good combustion auxiliary for diesel fuels. In particular, their solubility in the diesel fuel is in no way satisfactory. Consequently, it is impossible to guarantee the catalytic effect required for a substantial combustion of the fuel; accordingly, damaging deposits are formed in the essential parts of the engine, in particular the combustion chamber. Sulfur and phosphorus-containing salts also form undesirable combustion products which lead to emission problems. Finally, the known combustion auxiliaries are incompatible—or compatible only to a limited extent—with other substances added to the fuel, with the result that further undesired depositions are promoted.

It is, therefore, among the objects of the present invention to provide additives for improving the combustion of diesel fuels which do not have the afore-described disadvantages.

The invention consists of a process for improving the combustion of diesel engine fuels by inclusion of salts of organic acids. The invention is characterized in that a mixture of neutral salts of carboxylic acids and metals of Atomic Nos. 57 to 71 and free carboxylic acids is added to the fuels.

It has been found that the process according to the invention, i.e. the addition of neutral salts of organic acids with specific metals in conjunction with free carboxylic acids, results in a satisfactory combustion of the diesel fuels without the occurrence of deposits. Moreover, the smoke spot number (soot number), which is a measure of the completeness of combustion of a fuel, is clearly reduced compared with fuels which are not formulated according to the present invention. Of particular importance is the fact that the carbon monoxide concentration and nitrogen oxide concentration are considerably reduced by the present invention. Finally, it has been found that, compared with measures employed according to the state of the art, the present invention provides a saving in fuel of at least 2%, depending on the speed. Also, the acceleration time in the high engine revolution range is reduced compared with prior art fuels.

One component of the mixture added to the inventive diesel fuels are neutral salts of carboxylic acids. By neutral salts within the context of the invention are intended those salts in which all the metal valences have been neutralized by carboxylic acid radicals. It is possible to use salts of widely different carboxylic acids; both aliphatic and aromatic carboxylic acids are suitable. Salts of aliphatic monocarboxylic acids, in particular aliphatic monocarboxylic acids with 4 to 10 carbom atoms, have proved especially suitable. These carboxylic acids may be singly or multiply branched. In addition to isooctanoic acid, carboxylic acids branched in the $\alpha$-position, such as 2-ethylbutyric acid and 2-ethylhexanoic acid, are particularly important. By the aforementioned isooctanoic acid is meant the $C_8$carboxylic acid mixture containing the predominantly isomeric dimethylhexanoic acid. This carboxylic acid mixture is obtained by hydroformylation of a technical heptene mixture followed by oxidation of the hydroformylation product. Carboxylic acids obtained by addition of carbon monoxide and water to olefins by the Koch process are also suitable. Such acids include pivalic acid, 2,2-dimethylvaleric acid and neohexanoic acid.

According to the process of the invention, unitary salts may be used; i.e. salts containing only one cation. It is also possible to use salts containing various metals, or even mixtures of various salts. These include mixtures of salts of the same metals and different acids, of salts of different metals and the same acids, and of salts of different metals and different acids. It is particularly convenient to use those salts derived from the naturally occurring cerite earths. Cerite earths are minerals containing the elements of Atomic Nos. 57 to 71, i.e. lanthanum and the so-called lanthanoids, in varying amounts. Salts derived from the mineral bastnasite, which is available in large amounts, have proved particularly suitable.

The salts are obtained in a manner known per se. Thus, solutions of the nitrates of the metals may be used as starting materials; these are then converted with the stoichiometric amount of the sodium salts of the carboxylic acids. The sodium salts of the carboxylic acids are conveniently used in the form of a solution in an organic solvent in which the reaction product, i.e. the lanthanoid salts, is also soluble. They are obtained from the solution by distilling off the solvent, and no further purification operations are necessary. The nitrates of the metals are obtained directly by digestion with nitric acid when using minerals as the starting material.

According to the invention, further constituents of the mixtures added to the diesel fuel are free carboxylic acids. In principle, all carboxylic acids which are soluble in diesel engine fuels can be used. It has proved extremely convenient to use as carboxylic acids those acids present as acid radicals in the salts forming the constituents of the mixture.

The mixture contains 0.1 to 2 mols, preferably 0.2 to 1.5 mols, of free carboxylic acids referred to 1 mol of salt. It has proved particularly useful to use 0.5 to 1.0 mol of free carboxylic acid.

Petroleum middle distillates are not the only diesel engine fuels which can be improved by the invention. The invention can also be used with great success for diesel fuels based on natural oils. By the term natural oils is meant vegetable oils; including e.g. olive oil, groundnut oil, sesame oil, sunflower oil and rapeseed oil. It is particularly surprisingly that the new procedure can also be used for these oils since they fundamentally differ from mineral oils as regards their physical state and chemical behaviour. The use of vegetable oils in diesel engines gives rise to considerable problems, due to the formation of lacquers and the substantially greater amounts of soot when compared with mineral oils. Both phenomena are due to the fact that the natural products are unsaturated compounds. It is surprising that the new process considerably facilitates the use of natural oils as diesel engine fuels.

The mixtures of salts of organic acids of lanthanoids and free carboxylic acids used in the invention to improve combustion are added to the diesel engine fuels in such amounts that their concentration is 5 to 200 mg of lanthanoid metal or metal mixture per kg of fuel. In mineral oil-based fuels, concentrations of 10 to 50 mg, and in natural oil-based fuels, concentrations of 10 to 100 mg, of lanthanoid metal or metal mixture per kg of fuel have proved particularly suitable.

TESTS

The diesel fuel employed in the following tests contains 15 mg Ce as Ce(III)-2-ethylhexanoate/2-ethylhexanoic acid mixture per kg.

The basis of the investigations is the ECE-15 vehicle cycle, which is used for exhaust gas investigations according to the European regulations and for fuel consumption measurements according to DIN No. 70 030. The following engine is used:

| | |
|---|---|
| Car engine | VW Golf |
| Type of engine | Diesel |
| Number of cylinders | 4 |
| Engine capacity | 1588 $cm^3$ |
| Compression | 23 |
| Piston stroke | 86.4 mm |
| Transmission ratio | 29.21 |

Fuel consumption measurements are made at 50 km/h, 90 km/h and 120 km/h; 20 measurements are taken in each case and the standard deviation is calculated. The measurements are carried out with diesel fuel plus additive compared with diesel fuel without additive. In the case of diesel fuel with additive, a reduced consumption of at least

| 50 km/h | 90 km/h | 120 km/h |
|---|---|---|
| 0.3% | 0.71% | 2% |

is achieved.

The influence of the additive on the acceleration time is manifested in the higher rpm range as a reduction in the acceleration times, which are measured at full throttle starting from 1000 rpm up to 4500 rpm. In this case, also, 20 measurements are made and the standard deviation calculated.

Carbon monoxide, carbon dioxide, hydrocarbons and nitrogen oxides are found in the exhaust gases in amounts depending on the rpm. The values obtained are calculated in terms of amount per unit time (g/h), and amount per horsepower (g/kWh). The advantage of the novel diesel fuel can be recognized both under full engine load (Tables 1 and 2) and partial engine load (Tables 3 and 4).

TABLE 1

| | CO g/h | | $CC_2$ g/h | | $CH_2$ g/h | | $NO_x$ g/h | |
|---|---|---|---|---|---|---|---|---|
| Revs/Min. | LP 801 | LP 802 | LP 801 | LP 802 | LP 801 | LP 802 | LP 801 | LP 802 |
| 1003/1000 | 14,1 | 11,05 | 5,682 | 6,408 | 1,0 | 0,639 | 27,4 | 20,90 |
| 1252/1250 | 36,6 | 28,2 | 8,962 | 9,362 | 1,52 | 0,967 | 30,2 | 24,85 |
| 1500/1499 | 33,7 | 30,41 | 11,178 | 11,496 | 1,46 | 0,847 | 37,0 | 30,73 |
| 1749 | 27,39 | 27,0 | 12,444 | 13,163 | 1,53 | 1,124 | 45,4 | 34,42 |
| 2001 | 30,28 | 28,1 | 14,153 | 14,930 | 1,60 | 1,418 | 52,4 | 42,63 |
| 2249/2250 | 34,72 | 27,9 | 15,662 | 15,666 | 2,362 | 2,15 | 60,5 | 47,18 |
| 2500/2502 | 30,51 | 40,0 | 17,972 | 18,287 | 3,236 | 2,81 | 74,0 | 56,92 |

Full engine load
LP 801 Diesel fuel
LP 802 Diesel fuel plus additive

TABLE 2

| | CO g/KWh | | $CO_2$ g/KWh | | $CH_2$ g/KWh | | $NO_x$ g/KWh | |
|---|---|---|---|---|---|---|---|---|
| Revs./Min. | LP 801 | LP 802 | LP 801 | LP 802 | LP 801 | LP 802 | LP 801 | LP 802 |
| 1003/1000 | 1,92 | 1,549 | 796,2 | 868 | 0,136 | 0,0895 | 3,71 | 2,937 |
| 1252/1250 | 3,28 | 2,564 | 814,7 | 839 | 0,136 | 0,0879 | 2,709 | 2,259 |
| 1500/1499 | 2,4 | 2,188 | 804,1 | 818 | 0,104 | 0,0609 | 2,63 | 2,211 |
| 1749 | 1,73 | 1,65 | 785,9 | 806 | 0,094 | 0,071 | 2,782 | 2,174 |
| 2001 | 1,67 | 1,51 | 781,2 | 801 | 0,086 | 0,0782 | 2,812 | 2,353 |
| 2249/2250 | 1,738 | 1,40 | 784,4 | 785 | 0,108 | 0,1182 | 3,031 | 2,362 |
| 2500/2502 | 2,225 | 1,74 | 791,6 | 794 | 0,1425 | 0,122 | 3,213 | 2,507 |

Full engine load
LP 801 Diesel fuel
LP 802 Diesel fuel plus additive

TABLE 3

| | CC g/h | | $CO_2$ g/h | | $CH_2$ g/h | | $NO_x$ g/h | |
|---|---|---|---|---|---|---|---|---|
| Revs./Min. | LP 801 | LP 802 | LP 801 | LP 802 | LP 801 | LP 802 | LP 801 | LP 802 |
| 1043 | 5,4 | 4,5 | 2.977 | 3.016 | 0,63 | 0,66 | 32,1 | 26 |
| 1385/1387 | 7,3 | 6,6 | 4.057 | 4.302 | 0,93 | 0,95 | 30,8 | 33,4 |
| 1733 | 10,5 | 9,1 | 5.428 | 5.575 | 1,38 | 1,36 | 38,1 | 38,2 |
| 2080 | 20,2 | 17,1 | 7.266 | 7.455 | 1,86 | 1,74 | 58,8 | 54,2 |
| 2426 | 37,7 | 29,5 | 9.379 | 9.547 | 2,82 | 2,76 | 77,6 | 70,1 |
| 2772/2773 | 79,7 | 53,2 | 11.732 | 12.178 | 5,1 | 6,1 | 100,1 | 96,1 |
| 3123/3120 | 161,4 | 99,8 | 15.051 | 15.552 | 12,7 | 16,99 | 148,5 | 146,2 |
| 3447 | 217,4 | 178,4 | 18.757 | 19.375 | 26,81 | 26,26 | 208,9 | 189,6 |
| 3813 | 264,8 | 246,8 | 21.752 | 23.105 | 41,25 | 36,6 | 204,9 | 216,8 |
| 4160/4162 | 319,6 | 286 | 29.079 | 30.250 | 44,56 | 55,32 | 204 | 212,6 |
| 4506/4507 | 334,3 | 310 | 33.567 | 33.931 | 62,99 | 54,32 | 205,3 | 210,3 |

Partial engine load
LP 801 Diesel fuel
LP 802 Diesel fuel plus additive

TABLE 4

| | CO g/KWh | | $CO_2$ g/KWh | | $CH_2$ g/KWh | | $NO_x$ g/KWh | |
|---|---|---|---|---|---|---|---|---|
| Revs./Min. | LP 801 | LP 802 | LP 801 | LP 802 | LP 801 | LP 802 | LP 801 | LP 802 |
| 1043 | 2,47 | 2,03 | 1.337 | 1.379 | 0,303 | 0,281 | 14,43 | 11,87 |
| 1385/1387 | 2,04 | 1,98 | 1.215 | 1,202 | 0,279 | 0,266 | 9,22 | 9,32 |
| 1733 | 2,17 | 1,88 | 1.125 | 1.152 | 0,286 | 0,282 | 7,9 | 7,91 |
| 2080 | 2,97 | 2,49 | 1.061 | 1.095 | 0,271 | 0,256 | 8,58 | 7,96 |
| 2426 | 4,14 | 3,18 | 1.012 | 1.047 | 0.304 | 0,302 | 8.37 | 7,69 |
| 2772/2773 | 6,49 | 4,33 | 956 | 991 | 0,496 | 0,416 | 8,15 | 7,82 |
| 3123/3120 | 10,05 | 6,2 | 936 | 968 | 1.658 | 0,789 | 9,23 | 9,1 |
| 3447 | 10,53 | 8,75 | 920 | 939 | 1.315 | 1.273 | 10,25 | 9,19 |
| 3813 | 10,17 | 9,52 | 835 | 891 | 1.584 | 1.412 | 7,87 | 8,36 |
| 4160/4162 | 9,83 | 8,88 | 903 | 931 | 1.702 | 1.384 | 6,34 | 6,54 |
| 4506/4507 | 9,71 | 9,08 | 975 | 994 | 1.829 | 1.591 | 5,96 | 6,16 |

Partial engine load
LP 801 Diesel fuel
LP 802 Diesel fuel plus additive

We claim:

1. A process for improving the combustion of diesel engine fuels comprising adding an effective amount of a mixture of (a) neutral metal salts of carboxylic acids and (b) free carboxylic acids to said fuels, wherein said salts are metals of atomic numbers 57–71 and aliphaitic monocarboxylic acids having 4–10 carbon atoms, and said free carboxylic acids are selected from aliphatic monocarboxylic acids having 4–10 carbon atoms.

2. A process for improving the combustion of diesel engine fuels comprising adding an effective amount of a mixture of (a) neutral metal salts of carboxylic acids and (b) free carboxylic acids to said fuels, wherein said salts are metals of atomic numbers 57–71 and aliphatic monocarboxylic acids having 4–10 carbon atoms.

3. A diesel engine fuel comprising a mixture of free carboxylic acids and carboxylic acid salts wherein said carboxylic acid salts are salts of metals of atomic numbers 57–71 and aliphatic monocarboxylic acids having 4–10 carbon atoms.

4. A diesel engine fuel comprising a mixture of free carboxylic acids and carboxylic acid salts wherein said carboxylic acid salts are salts of metals of atomic numbers 57–71 and aliphatic monocarboxylic acids having 4–10 carbon atoms, and said free carboxylic acids are selected from aliphatic monocarboxylic acids having 4–10 carbon atoms.

5. The process of claim 1 wherein the aliphatic monocarboxylic acids are singly or multiply branched.

6. The process of claim 5 wherein the aliphatic monocarboxylic acids are branched in the $\alpha$-position.

7. The process of claim 1 wherein the aliphatic monocarboxylic acids are 2-ethylbutyric acid, 2-ethylhexanoic acid and/or isooctanoic acid.

8. The process of claim 1 wherein the salts contain the metals individually or in the form of mixtures thereof.

9. The process of claim 8 wherein the salt mixtures are derived from the naturally occurring cerite earths.

10. The process of claim 9 wherein the salt mixtures are derived from the mineral bastnasite.

11. The process of claim 1 wherein 0.1 to 1 mol of said free carboxylic acids is used per mol of said salt.

12. The process of claim 11 wherein 0.2 to 0.4 mols of said free carboxylic acid is used per mol of said salt.

13. The process of claim 1 wherein the fuel comprises a natural oil.

14. The process of claim 13 wherein the natural oil is sunflower oil and/or rapeseed oil.

15. The process of claim 1 wherein the fuel is a mixture of mineral oil and natural oil.

16. The process of claim 1 wherein 5 to 200 mg of a lanthanoid metal or a lanthanoid metal mixture is added per kg of said fuel.

17. The process of claim 1 wherein 10 to 50 mg of a lanthanoid metal or a metal mixture is added per kg of mineral oil-based fuel.

18. The process of claim 1 wherein 10 to 100 mg of a lanthanoid metal or a metal mixture is added per kg of natural oil-based fuel.

19. The fuel of claim 4 wherein said monocarboxylic acids are singly or multiply branched.

20. The fuel of claim 19 wherein said monocarboxylic acids are branched in the $\alpha$-position.

21. The fuel of claim 4 wherein said monocarboxylic acids are 2-ethylbutyric acid, 2-ethylhexanoic acid, and/or isooctanoic acid.

22. The fuel of claim 4 wherein the salts contain said metals individually or as mixtures thereof.

23. The fuel of claim 22 wherein the salt mixtures are derived from naturally occurring cerite earths.

24. The fuel of claim 22 wherein said salt mixtures are derived from bastnastite.

25. The fuel of claim 4 wherein there is present 0.1 to 1.0 mol of said free carboxylic acids per mol of said salt.

26. The fuel of claim 25 wherein there is present 0.2 to 0.4 mols of said free carboxylic acid per mol of said salt.

27. The fuel of claim 4 which comprises a natural oil.

28. The fuel of claim 27 which comprises sunflower oil and/or rapeseed oil.

29. The fuel of claim 4 which comprises a mixture of mineral oil and natural oil.

30. The fuel of claim 4 which comprises 5 to 200 mg of a lanthanoid metal or a lanthanoid metal mixture per kg.

31. The fuel of claim 4 which comprises 10 to 50 mg of said lanthanoid metal or metal mixture per kg of mineral oil-based fuel.

32. The fuel of claim 4 which comprises 10 to 100 mg of a lanthanoid metal or metal mixture per kg of natural oil-based fuel.

* * * * *